US005519228A

United States Patent [19]

Takasu et al.

[11] Patent Number: 5,519,228

[45] Date of Patent: May 21, 1996

[54] RADIATION IMAGE STORAGE PANEL AND ITS PREPARATION

[75] Inventors: Atsunori Takasu; Yuichi Hosoi, both of Kanagawa, Japan

[73] Assignee: Fuji Photo Film Co., Ltd., Minami-ashigara, Japan

[21] Appl. No.: 412,689

[22] Filed: Mar. 29, 1995

[30] Foreign Application Priority Data

Apr. 15, 1994 [JP] Japan ..... 6-101994
Jul. 20, 1994 [JP] Japan ..... 6-190886

[51] Int. Cl.[6] ..... G21K 4/00

[52] U.S. Cl. ..... 250/484.4

[58] Field of Search ..... 250/484.4

[56] References Cited

U.S. PATENT DOCUMENTS 5,153,078 10/1992 Kojima et al. ..... 250/484.4

*Primary Examiner*—Carolyn E. Fields
*Attorney, Agent, or Firm*—Sixbey, Friedman, Leedom & Ferguson; Gerald J. Ferguson, Jr.

[57] ABSTRACT

A radiation image storage panel comprises a stimulable phosphor layer, a cushioning layer and a coated protective layer, wherein the cushioning layer shows an elongation at rupture more than that of the protective layer.

10 Claims, 2 Drawing Sheets

RADIATION IMAGE STORAGE PANEL AND ITS PREPARATION

FIELD OF THE INVENTION

The present invention relates to a radiation image storage panel using a stimulable phosphor and a process for preparing the radiation image storage panel.

BACKGROUND OF THE INVENTION

As a method replacing a conventional radiography, a radiation image recording and reproducing method utilizing a stimulable phosphor as described, for instance, in U.S. Pat. No. 4,239,968, was proposed and is practically employed. In the method, a radiation image storage panel comprising a stimulable phosphor (i.e., stimulable phosphor sheet) is employed, and the method involves the steps of causing the stimulable phosphor of the panel to absorb radiation energy having passed through an object or having radiated from an object; sequentially exciting the stimulable phosphor with an electromagnetic wave such as visible light or infrared rays (hereinafter referred to as "stimulating rays") to release the radiation energy stored in the phosphor as light emission (i.e., stimulated emission); photoelectrically detecting the emitted light to obtain electric signals; and reproducing the radiation image of the object as a visible image from the electric signals.

In the radiation image recording and reproducing method, a radiation image is obtainable with a sufficient amount of information by applying a radiation to an object at a considerably smaller dose, as compared with the conventional radiography using a combination of a radiographic film and radiographic intensifying screen. Further, the radiation image recording and reproducing method using a stimulable phosphor is of great value especially when the method is employed for medical diagnosis.

The radiation image storage panel employed in the above-described method has a basic structure comprising a support and a stimulable phosphor layer provided on one surface of the support. If the phosphor layer is self-supporting, however, the support may be omitted. Further, a transparent layer of a polymer material is generally provided on the free surface (surface not facing the support) of the phosphor layer to keep the phosphor layer from chemical deterioration or physical shock.

The phosphor layer generally comprises a binder and a stimulable phosphor (in the form of particles) dispersed therein. The stimulable phosphor emits light (gives stimulated emission) when it is exposed to radiation such as X-rays and then excited with an electromagnetic wave (i.e., stimulating rays). Accordingly, the radiation having passed through an object or radiated from an object is absorbed by the stimulable phosphor layer of the panel in proportion to the applied radiation dose, and a radiation image of the object is produced on the panel in the form of a radiation energy-stored image. The radiation energy-stored image can be released as stimulated emission by sequentially irradiating the panel with stimulating rays. The stimulated emission is then photoelectrically detected to give electric signals, so as to reproduce a visible image from the electric signals.

As described hereinbefore, the surface on the stimulable phosphor layer (opposite the surface facing the support) is provided with a protective layer to protect the phosphor layer from chemical deterioration or physical damage. The protective layer can be provided, for instance, by coating a solution of a transparent organic polymer such as a cellulose derivative or polymethyl methacrylate on the phosphor layer, by fixing a beforehand prepared polymer film such as a polyethylene terephthalate film on the phosphor layer with an adhesive, or by vacuum depositing an inorganic material on the phosphor layer.

The beforehand prepared polymer film such as polyethylene terephthalate film has a high strength. However, it needs complicated procedures for its preparation. Moreover, if the adhesive layer between the polymer film and the phosphor layer gives two interfaces, that is, that between the adhesive layer and the polymer film, and that between the adhesive layer and the phosphor layer. The increased interfaces cause increase of scattering of light passing through these layers, and the increased scattering causes lowering of quality of an image obtained in the radiation image recording and reproducing method.

In contrast, the coated protective layer can be readily prepared by coating a solution of polymer material on the phosphor layer, and the coated protective layer is firmly fixed on the phosphor layer. Particularly, a protective layer prepared simultaneously with a phosphor layer by a simultaneous coating method is fixed on the phosphor layer with sufficient bonding strength, and moreover thus prepared radiation image storage panel shows improved sensitivity and image quality (U.S. Pat. No. 4,728,583). It has been found by the present inventors that the protective layer directly coated on the phosphor layer sometimes produces cracks therein in the steps of the radiation image recording and reproducing method, as described below.

In the radiation image recording and reproducing method, the radiation image storage panel is repeatedly employed in the steps of radiation of X-rays (recording of radiation image), irradiation of stimulating rays (reading out of the recorded radiation image), and exposure to erasing light (erasure of residual radiation image). Between these steps, the storage panel is transferred by conveyors such as belts and/or rollers within the apparatus for the radiation image recording and reproducing method. In these steps, the coated protective layer of the storage panel sometimes produces therein cracks, probably, due to its rigid body. Particularly, the coated protective layer of a fluororesin (i.e., fluorocarbonresin) showing high anti-staining properties which is described in copending U.S. Ser. No. 08/333,325 is so brittle as to produce cracks therein. The radiation image storage panel having a cracked protective layer cannot give a reproduced radiation image of high quality because X-rays or stimulating rays impinged on the cracked protective layer is scattered on the cracked.

SUMMARY OF THE INVENTION

The present inventors have studied on the phenomenon of production of cracks on the coated protective layer of the radiation image storage panel and found that the cracked are easily produced on the coated protective layer because the coated protective layer shows an elongation at rupture of less than 50%, as compared with the conventional beforehand prepared protective film. A coated protective layer having such lower elongation at rupture easily produces cracks therein when the radiation image storage panel is repeatedly bent or repeatedly encounters physical shock in the radiation image reproducing apparatus.

Accordingly, the present invention has an object to provide a radiation image storage panel showing high durability in the transferring steps which are performed in the radiation image reproducing apparatus.

Particularly, the invention has an object to provide a radiation image storage panel continuously giving a reproduced radiation image of high quality in repeated transferring procedures for a long period of time.

Further, the invention provides a process for preparing a radiation image storage panel showing high durability.

The present invention resides in a radiation image storage panel comprising a stimulable phosphor layer, a cushioning layer and a coated protective layer, wherein the cushioning layer shows an elongation at rupture more than that of the protective layer.

Preferred embodiments of the invention are described below.

1) The cushioning layer shows an elongation at rupture of the cushioning layer is not less than 100%.

2) The cushioning layer shows an elongation at rupture in the range of 100 to 2,000%, preferably 300 to 2,000%.

3) The difference between the elongation at rupture of the cushioning layer and that of the protective layer is not less than 50%, preferably not less than 100%.

4) The cushioning layer comprises polyurethane.

5) The cushioning layer is independent of the phosphor layer, and there is seen an interface between the cushioning layer and the phosphor layer.

6) The cushioning layer is continuous from the phosphor layer, and no interface is observed between the phosphor layer and the cushioning layer.

7) The phosphor layer is arranged on a support.

8) The protective layer has an elongation at rupture of less than 100%.

9) The protective layer comprises a cellulose derivative, acrylic resin or fluororesin.

10) The protective layer comprises nitrocellulose.

11) The protective layer comprises polymethyl methacrylate.

12) The protective layer comprises a copolymer having a fluoroolefin as a monomer unit, polytetrafluoroethylene or modified polytetrafluoroethylene.

13) The protective layer comprises a cross-linked fluororesin.

The radiation image storage panel of the invention can be preferably prepared by coating a phosphor layer-forming coating dispersion (which contains particles of stimulable phosphor and a binder polymer in a solvent) and a cushioning layer-forming solution (which contains in a solvent a polymer showing an elongation at rupture greater than that of the polymer of the below-mentioned protective layer) simultaneously on a support to form a continuous layer comprising a stimulable phosphor layer and a cushioning layer on the support; and coating a protective layer-forming solution (which contains a polymer in a solvent) on the cushioning layer to form a coated protective layer.

DETAILED DESCRIPTION OF THE INVENTION

Figure 1:
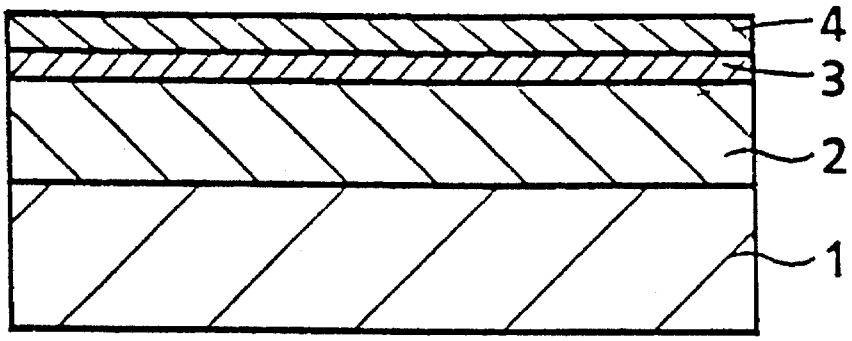
FIG. 1 shows a schematic section of a representative radiation image storage panel of the invention.

One representative structure of the radiation image storage panel of the invention is illustrated in FIG. 1, in which a phosphor layer 2, a cushioning layer 3 and a coated protective layer 4 are superposed on a support in order. In the structure of FIG. 1, the phosphor layer 2 and the cushioning layer 3 are produced independently of each other, there is seen an interface between these layers. However, if the independently formed phosphor layer 2 and cushioning layer 3 are combined under pressure and heating, the interface may be obscure. The protective layer 4 is directly formed on the cushioning layer 3 by coating method, and is made of a polymer showing an elongation at rupture smaller than that of the polymer of the cushioning layer 3. Accordingly, the coated protective layer 4 is a rigid layer. Typically, the polymer of the protective layer is a fluororesin.

Figure 2:
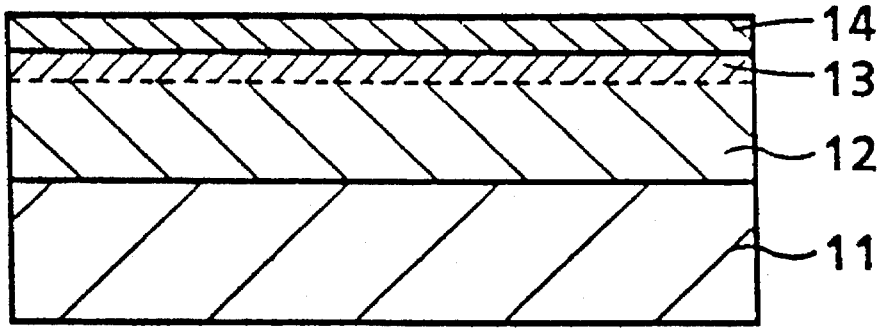
FIG. 2 shows a schematic section of another representative radiation image storage panel of the invention.

Another representative structure of the radiation image storage panel of the invention is illustrated in FIG. 2, in which a phosphor layer 12, a cushioning layer 13 and a coated protective layer 14 are superposed on a support 11 in order. In the structure of FIG. 2, the phosphor layer 2 and the cushioning layer 3 in combination forms a continuous layer, and there is seen no interface between these layers. Such continuous layer can be prepared, for instance, by an simultaneous coating method.

Details of the radiation image storage panel of the invention and the process for its preparation are described below.

The stimulable phosphor gives a stimulated emission when it is irradiated with stimulating rays after it is exposed to radiation. In the preferred radiation image storage panel, a stimulable phosphor giving a stimulated emission of a wavelength in the range of 300 to 500 nm when it is irradiated with stimulating rays of a wavelength in the range of 400 to 900 nm is employed. Examples of the preferred stimulable phosphors include divalent europium activated alkaline earth metal halide phosphors and a cerium activated alkaline earth metal halide phosphors. Both stimulable phosphors favorably give the stimulated emission of high luminance. However, the stimulable phosphors employable in the radiation image storage panel of the invention are not limited to the above-mentioned preferred stimulable phosphors.

The stimulable phosphor layer can be prepared using no binder polymer. For instance, the stimulable phosphor layer can be formed of aggregated phosphor particles which may be impregnated with a polymer. Otherwise, the stimulable phosphor layer can be formed on a support by vacuum deposition.

The following shows a process for preparing a stimulable phosphor layer comprising stimulable phosphor particles and a binder polymer.

The stimulable phosphor particles and the binder polymer are well mixed in an appropriate solvent to give a coating dispersion in which the phosphor particles are homogeneously dispersed in the binder solution. Examples of the binder polymers include natural polymer materials such as proteins (e.g., gelatin), polysaccharides (e.g., dextran), and gum arabic, and synthetic polymer materials such as polyvinyl butyral, polyvinyl acetate, nitrocellulose, ethyl cellulose, vinylidene chloride-vinyl chloride copolymer, polyalkyl (meth)acrylate, vinyl chloride-vinyl acetate copolymer, polyurethane, cellulose acetate butyrate, polyvinyl alcohol and linear polyester. These binder polymers can be used singly or in combination. Preferred are nitrocellulose, linear polyester, polyalkyl (meth)acrylate, polyurethane, a mixture of nitrocellulose and linear polyester, and a mixture of nitrocellulose and polyalkyl (meth) acrylate.

Examples of the solvents for the preparation of a phosphor layer-forming coating dispersion include lower alcohols such as methanol, ethanol, n-propanol, and n-butanol, chlorine atom-containing hydrocarbons such as methylene chloride and ethylene chloride, ketones such as acetone, methyl ethyl ketone, and methyl isobutyl ketone, esters of lower carboxylic acids and lower alcohols such as methyl acetate, ethyl acetate and butyl acetate, ethers such as dioxane, ethylene glycol monoethyl ether, ethylene glycol monomethyl ether, and tetrahydrofuran, and mixtures of two or more of these solvents.

In the coating dispersion, the binder polymer and the stimulable phosphor are introduced generally at a ratio of 1:1 to 1:100 (binder:phosphor, by weight), preferably 1:8 to 1:40 (by weight). The ratio can be varied depending the desired characteristics of the storage panel and natures of the binder polymers and phosphors.

The coating dispersion may contain additives such as a dispersant (which increases dispersibility of the phosphor in the binder polymer solution) and a plasticizer (which increase adhesion between the binder polymer and the phosphor particles in the phosphor layer). Examples of the dispersants include phthalic acid, stearic acid, caproic acid, and hydrophobic surfactants. Examples of the plasticizers include phosphoric acid esters such as triphenyl phosphate, tricresyl phosphate, and diphenyl phosphate, phthalic acid esters such as diethyl phthalate and dimethoxyethyl phthalate, glycolic acid esters such as ethylphthalylethyl glycolate and butylphthalylbutyl glycolate, and polyesters of polyethylene glycol and aliphatic dibasic acids such as polyesters of triethylene glycol and adipic acid and polyesters of diethylene glycol and succinic acid.

The coating dispersion of the phosphor and binder polymer in the solvent is then coated uniformly on a support to form a coated layer on the support. The coating can be performed by known coating means such as doctor blade, roll coater, and knife coater.

The support can be optionally selected from the known materials employed for the conventional radiation image storage panel. Examples of the known materials include films of plastic materials such as cellulose acetate, polyester (e.g., polyethylene phthalate), polyamide, polyimide, cellulose triacetate, and polycarbonate, metal sheets such as aluminum sheet and aluminum alloy sheet, ordinary paper, baryta paper, resin-coated paper, pigment paper containing a pigment (e.g., titanium dioxide), paper sized with polyvinyl alcohol or the like, and sheets of ceramics such as alumina, zirconia, magnesia and titania.

Some of the known radiation image storage panels have various auxiliary layers: for instance, an adhesive layer which is formed of a polymer material such as gelatin or an acrylic resin on the support and which enhances strength between the support and the phosphor layer or increases sensitivity or image quality (e.g., sharpness and graininess) of the obtainable radiation image; a light-reflecting layer of a light reflecting material such as titanium dioxide; and a light-absorbing layer of a light-absorbing material such as carbon black. The radiation image storage panel of the invention may have one or more of such auxiliary layers.

Further, the support of the radiation image storage panel of the invention may have a great number of a very small convexes or concaves on its surface. If the support is coated with one or more auxiliary layers, the convexes or concaves may be formed on these layers. The great number of a very small convexes or concaves can improves sharpness of the radiation image reproduced by the use of the storage panel.

The coated phosphor layer is then dried to give the desired stimulable phosphor layer. The stimulable phosphor layer generally has a thickness of 20 μm to 1 mm, preferably 50 to 500 μm. The thickness of the phosphor layer may be varied depending on the characteristics of the radiation image storage panel to be prepared, the natures of the phosphor, and the ratio of the binder polymer to the phosphor.

The coating dispersion of the phosphor layer can be coated on a sheet other than the support. For instance, the coating dispersion can be coated on a glass sheet, a metal sheet, a plastic sheet or a sheet of other material. The coated phosphor dispersion is dried to give a phosphor layer and then separated from the sheet. The dried phosphor layer (i.e., phosphor sheet) can be used per se with no support or fixed on the genuine support under pressure, optionally using an adhesive.

The cushioning layer is made of a polymer and shows an elongation at rupture (or elongation at breakage) higher than that of the protective layer coated thereon. The elongation at rupture of the cushioning layer of the invention generally is 100% or more, preferably in the range of 100 to 2,000%, more preferably in the range of 300 to 2,000%, and most preferably in the range of 500 to 2,000%. Further, the elongation at rupture of the cushioning layer is higher (or greater) than that of the coated protective layer generally by not less than 50%, preferably by not less than 100%, more preferably by not less than 300%, and most preferably by not less than 500%. The elongation at rupture can be determined by the known method such as that defined in JIS-K6301.

Examples of the polymer material for the formation of the cushioning layer include polyurethane (typically polyurethane elastomer), polyvinyl chloride (typically polyvinyl chloride elastomer), polyethylene, polypropylene, polyester (typically polyester elastomer), polyamide (typically polyamide elastomer), silicone, polystyrene elastomer, polyolefin elastomer, 1,2-polybutadiene elastomer, ethylene-vinyl acetate elastomer, natural rubber elastomer, polyisoprene elastomer, chlorinated polyethylene elastomer, and silicone elastomer. The cushioning layer of the invention can be prepared using one or more of these polymer materials to satisfy the required elongation at rupture. Preferred are polyurethane elastomer, polyester elastomer, and chlorinated polyethylene elastomer. Most preferred is polyurethane elastomer.

The cushioning layer can be prepared by the steps of preparing a cushioning layer-forming coating solution by dissolving one or more polymers selected from the above-mentioned polymers in an appropriate solvent, coating the coating solution uniformly on the phosphor layer, and drying the coated solution. The coating procedure can be done using known coating means such as doctor blade, roll coater or knife coater.

The coating solution for formation of the cushioning layer further can contain a polymer other than the above-mentioned polymers, a crosslinking agent (e.g., polyisocyanate compound), a coloring agent, an anti-yellowing agent (e.g., epoxy resin), and an electroconductivity-imparting agent).

The cushioning layer preferably has a thickness in the range of 0.1 to 50 μm, more preferably 0.5 to 20 μm.

The formation of the cushioning layer is preferably done simultaneously with the formation of the stimulable phosphor layer by a simultaneous coating method. The simultaneous coating method can be performed by the steps of:

coating a phosphor layer-forming coating dispersion which contains particles of stimulable phosphor and a binder polymer in a solvent and a cushioning layer-forming solution which contains in a solvent a polymer showing an elongation at rupture greater than that of the polymer of the below-mentioned protective layer simultaneously on a support to form a continuous layer comprising a stimulable phosphor layer and a cushioning layer on the support; and coating a protective layer-forming solution which contains a polymer in a solvent on the cushioning layer to form a coated protective layer.

The phosphor layer and the cushioning layer have no clear interface between them, and the bonding strength between these layers are very high.

On the cushioning layer is coated a protective layer.

The elongation at rupture of the protective layer generally is smaller than 100%, preferably in the range of 5 to 50%. For instance, a protective layer of polymethyl methacrylate generally has an elongation at rupture of less than 40%, particularly in the range of 2 to 10%, and a protective layer of nitrocellulose generally has an elongation at rupture of less than 100%, particularly in the range of 5 to 45%.

The protective layer of the radiation image storage panel of the invention is made of an organic polymer soluble in an organic solvent, and is directly formed on the cushioning layer. Examples of the organic polymers include fluororesins, acrylic resins such as polymethyl methacrylate, cellulose derivatives such as nitrocellulose, acetylcellulose and cellulose butyrate, polyurethane resins, polyester resins, polyvinyl butyral resin, polycarbonate and epoxy resins. The polymer material of the protective layer is so selected as to have an elongation at rupture smaller than that of the cushioning layer.

The protective layer is preferably made of a fluororesin (namely, a fluorine atom-containing resin). The fluororesin is a homopolymer of a fluorine atom-containing olefin or a copolymer of a fluorine atom-containing olefin and other monomer. Examples of the fluororesins include polytetrafluoroethylene, polychlorotrifluoroethylene, polyfluorinated vinyl, polyfluorinated vinylidene, tetrafluoroethylene-hexafluoropropylene copolymer, and fluoroolefin-vinyl ether copolymer. Most of the fluororesins are insoluble in organic solvents. However, copolymers of the fluoroolefin and comonomer can be made soluble in a certain organic solvent if an appropriate comonomer is chosen. Therefore, such soluble fluororesins can be dissolved in an appropriate organic solvent to prepare a coating solution. The coating solution of the fluororesin is coated on the cushioning layer and dried to give a coated protective layer of the fluororesin. Further, if an appropriate fluorine atom-containing organic solvent such as a perfluoro solvent is chosen, polytetrafluoroethylene and its modified polymer can be soluble in the chosen solvent. The prepared solution can be coated on the cushioning layer in the same manner as above to form the coated protective layer.

The above-mentioned fluororesins can be employed singly or in combination with other fluororesins or polymers other than the fluororesins to form the protective layer. However, if the protective layer should have enough anti-staining properties, the protective layer should contain the fluororesin at least 30 weight %, preferably at least 50 weight %, more preferably not less than 70 weight %.

The protective layer of the fluororesin is preferably crosslinked to increase strength and durability of the protective layer. Accordingly, the protective layer-forming coating solution can further contain a crosslinking agent. An anti-yellowing agent can be also incorporated into the coating solution.

The protective layer can be formed by coating on the cushioning layer a protective layer-forming coating solution which contains an organic polymer dissolved in an organic solvent, and drying the coated layer. Otherwise, the protective layer and the cushioning layer can be formed simultaneously by the simultaneous coating method as described above.

The protective layer generally has a thickness in the range of 0.5 to 20 μm, preferably in the range of 1 to 10 μm.

The radiation image storage panel of the invention can be prepared by the above-described process. However, the radiation image storage panel can be modified in the known manners. For instance, one or more layers of constituting the radiation image storage panel can be so colored as to well absorb the stimulating rays and not to absorb the stimulated emission. Such coloring sometimes is effective to increase sharpness of the image obtained by the use of the storage panel. Otherwise, an independent colored layer can be placed in an appropriate position of the storage panel for the same purpose.

Examples embodying the present invention are given below.

EXAMPLE 1

[Preparation of Stimulable Phosphor Layer]

| Composition | |
|---|---|
| Stimulable phosphor ($BaFBr_{0.9}I_{0.1}:Eu^{2+}$) | 200 g |
| Binder: Polyurethane elastomer (Pandex T-5265H (solid), product of Dai-Nippon Ink Chemical Industries Co., Ltd.) | 8.0 g |
| Anti-yellowing agent: Epoxy resin (Epikote 1001 (solid), product of Yuka Shell Epoxy Co., Ltd.) | 2.0 g |

The above composition was placed in methyl ethyl ketone and dispersed by means of a propeller mixer to give a coating dispersion of a viscosity in the range of 25 to 30 PS (at 25° C.) in which the ratio of binder to phosphor was 1/20. The coating dispersion was coated on a polyethylene terephthalate sheet (thickness: 300 μm) on its undercoating layer side. The coated layer was dried at 100° C. for 15 minutes to give a stimulable phosphor layer of a thickness of 200 μm.

[Preparation of Cushioning Layer]

| Composition | |
|---|---|
| Polymer: Polyurethane elastomer (Pandex T-5265H (solid), product of Dai-nippon Ink Chemical Industries Co., Ltd.) | 8.0 g |
| Anti-yellowing agent: Epoxy resin (Epikote 1001 (solid), product of Yuka Shell Epoxy Co., Ltd.) | 2.0 g |

The above composition was placed in methyl ethyl ketone and dissolved by means of a propeller mixer to give a coating solution of a viscosity in the range of 0.5 to 0.8 PS (at 25° C.). The coating solution was coated on the stimulable phosphor layer. The coated layer was dried at 100° C. for 10 minutes to give a cushioning layer of a thickness of 5 μm.

[Preparation of Coated Protective Layer]

| Composition | |
|---|---|
| Fluororesin: Fluoroolefin-vinyl ether copolymer (Lumiflon LF-100 (50% xylene solution), product of | 50 g |

-continued

| [Preparation of Coated Protective Layer] | |
|---|---|
| Composition | |
| Asahi Glass Co., Ltd.) | |
| Cross-linking agent: Isocyanate (Colonate HX (solid content: 100%), product of Nippon Polyurethane Industries Co., Ltd.) | 5 g |
| Alcohol modified-silicone (X-22-2809 (solid content: 66%), product of Shin-etsu Chemical Industries Co., Ltd.) | 0.5 g |

The above composition was placed in methyl ethyl ketone and dissolved to give a coating solution of a viscosity in the range of 0.1 to 0.3 PS (at 25° C.). The coating solution was coated on the cushioning layer. The coated layer was dried at 120° C. for 30 minutes for heat-curing to give a coated protective layer of a thickness of 5 μm.

Thus, a radiation image storage panel of the invention comprising a support, a undercoating layer, a stimulable phosphor layer, a cushioning layer, and a protective layer was prepared.

EXAMPLE 2

The procedures of Example 1 were repeated except for changing the compositions of the cushioning layer and the protective layer and further changing the solvent of the coating solution for the preparation of the cushioning layer to a mixture of methyl ethyl ketone and tetrahydrofuran (3/7, volume ratio), to prepare a radiation image storage panel of the invention comprising a support, a undercoating layer, a stimulable phosphor layer, a cushioning layer, and a protective layer.

| Composition for cushioning layer | |
|---|---|
| Polymer: Polyurethane elastomer (Kuramylon U-8165 (solid), product of Kuraray Co., Ltd.) | 10 g |
| **Composition for coated protective layer** | |
| Fluororesin: Fluoroolefin-vinyl ether copolymer (Lumiflon LF-504X (40% xylene solution), product of Asahi Glass Co., Ltd.) | 50 g |
| Cross-linking agent: Isocyanate (Olester NP-38-70S (70% ethyl acetate solution), product of Mitsui-Toatsu Chemical Co., Ltd.) | 10 g |
| Alcohol modified-silicone (X-22-2809 (solid content: 66%), product of Shin-etsu Chemical Industries Co., Ltd.) | 0.5 g |

The above composition was placed in methyl ethyl ketone and dissolved to give a coating solution of a viscosity in the range of 0.1 to 0.3 PS (at 25° C.). The coating solution was coated on the cushioning layer. The coated layer was dried at 120° C. for 30 minutes for heat-curing to give a coated protective layer of a thickness of 5 μm.

Thus, a radiation image storage panel of the invention comprising a support, a undercoating layer, a cushioning layer, and a protective layer was prepared.

Comparison Example 1

The procedures of Example 1 were repeated except for placing no cushioning layer to prepare a radiation image storage panel for comparison comprising a support, a undercoating layer, a stimulable phosphor layer, and a protective layer.

Comparison Example 2

The procedures of Example 2 were repeated except for placing no cushioning layer to prepare a radiation image storage panel for comparison comprising a support, a undercoating layer, a stimulable phosphor layer, and a protective layer.

Measurement of Elongation at Rupture

Each of the cushioning layer-forming coating solution and the protective layer-forming coating solution was coated on a releasing layer which was provided on a polyethylene terephthalate sheet and dried in the same manner as in the above-described Examples. The dried layer was peeled off the polyethylene terephthalate sheet to prepare a dumbbell specimen (thickness: 30 μm, effective width: 10 mm, effective length 40 mm).

A tensile machine (Tensilon UTM-11-20, available from Toyo Boldwin Co., Ltd.) which was designed in accordance with JIS-B-7721 was employed for the measurement of elongation at rupture under the following conditions (in accordance with JIS-K6301):

The specimen was set between the grips (distance: 40 mm) and the grips were separated at a grip separation rate of 40 mm/min. at 25° C., 50% RH.

Evaluation of Transferring Durability

Figure 3:
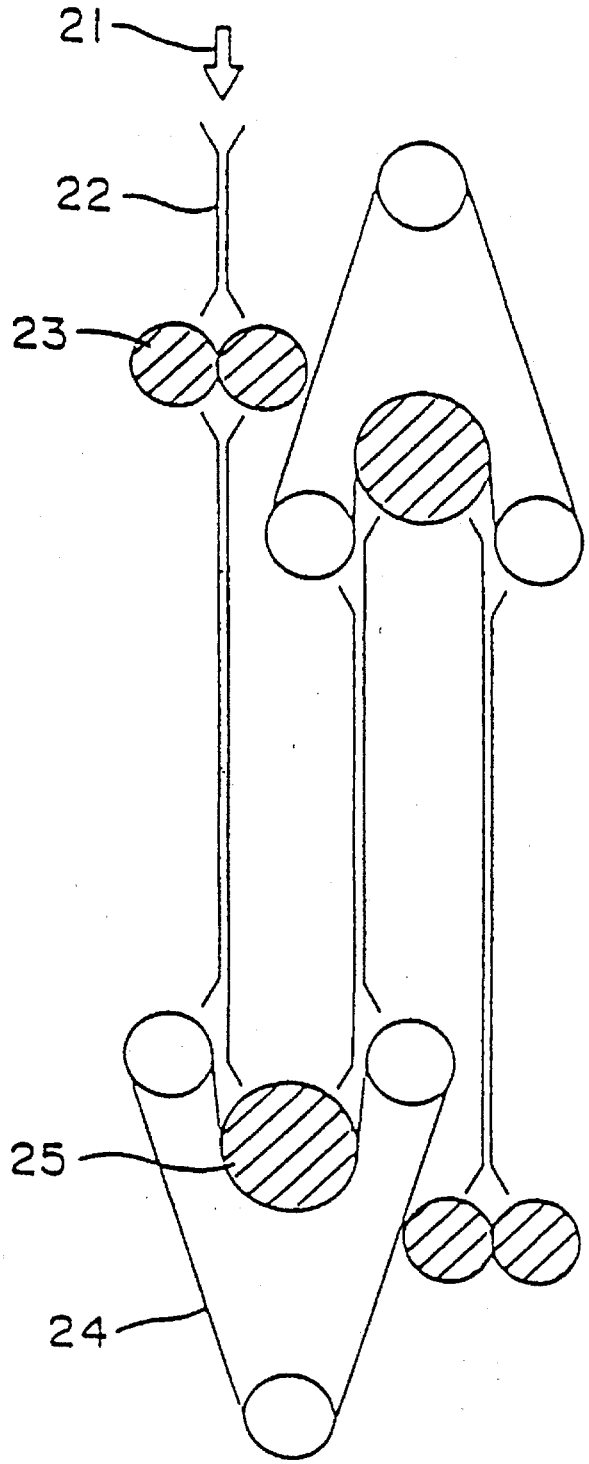
FIG. 3 shows an apparatus employed for evaluating the transferring durability of the radiation image storage panel.

The radiation image storage panel prepared in the Examples was cut to give a test sheet of 100 mm×250 mm, which was then transferred on the transfer test machine illustrated in FIG. 3. The test sheet was introduced from the entrance 21 to pass through the guide plates 22 and nip rolls (diameter: 25 mm) 23. The test sheet was moved on the conveyor belt 24 to successively bend inward and outward along the rubber rolls (diameter: 40 mm) 25 and then was taken out through guide plates and nip rolls. This transferring procedure was repeated up to 10,000 cycles under observation of the production of cracks on the protective layer of the test sheet.

The results and the elongations at rupture of the respective protective layers and cushioning layers are set forth in Table 1.

TABLE 1

| | Transferring Durability | Elongation at Rupture | |
|---|---|---|---|
| | (cracks on protective layer) | Cushioning layer | Protective layer |
| Example 1 | Not observed after 10,000 cycles | 900% | 10% |
| Example 2 | Not observed after 10,000 cycles | 800% | 40% |
| Com. Ex. 1 | Observed after 3,000 cycles | — | 10% |
| Com. Ex. 2 | Observed after 3,000 cycles | — | 40% |

Further, no staining was observed on all the test sheets at the sites where the test sheets had been in contact with the transferring means after 3,000 cycles.

From the results shown in Table 1 and the above results, it has been confirmed that the radiation image storage panels of the invention are resistant to staining and have satisfactory transferring durability.

EXAMPLE 3

[Preparation of Stimulable Phosphor Layer]

| Composition | |
|---|---|
| Stimulable phosphor ($BaFBr_{0.85}I_{0.15}:Eu^{2+}$) | 200 g |
| Binder: Polyurethane elastomer (Desmolack TPKL-5-2625 (solid content: 40%), product of Sumitomo Bayer Urethane Co., Ltd.) | 17.8 g |
| Cross-linking agent: Isocyanate (Colonate HX (solid content: 100%), product of Nippon Polyurethane Industries Co., Ltd.) | 0.9 g |
| Anti-yellowing agent: Epoxy resin (Epikote 1001 (solid), product of Yuka Shell Epoxy Co., Ltd.) | 2.0 g |

The above composition was placed in methyl ethyl ketone and dispersed by means of a propeller mixer to give a coating dispersion of a viscosity of 30 PS (at 25° C.) in which the ratio of binder to phosphor was 1/20.

[Preparation of Cushioning Layer]

| Composition | |
|---|---|
| Polymer: Polyurethane elastomer (Desmolack TPKL-5-2625 (solid content: 40%), product of Sumitomo Bayer Urethane Co., Ltd.) | 20.0 g |
| Anti-yellowing agent: Epoxy resin (Epikote 1001 (solid), product of Yuka Shell Epoxy Co., Ltd.) | 2.0 g |

The above composition was placed in methyl ethyl ketone and dissolved by means of a propeller mixer to give a coating solution of a viscosity in the range of 0.5 to 0.8 PS (at 25° C.).

The coating dispersion of phosphor layer and the coating solution of cushioning layer were simultaneously coated on a polyethylene terephthalate sheet (thickness: 180 μm having a undercoating silicon releasing layer, temporary support) on its releasing layer side under the condition that the coating solution of cushioning layer was placed above the coating dispersion of phosphor layer. The coated layers were dried and peeled off the support to give a stimulable phosphor sheet of 140 μm thick composed of a stimulable phosphor layer of 135 μm thick and a cushioning layer of 5 μm thick with no clear interface between these layers.

[Preparation of Subbing Layer on Support]

| Composition | |
|---|---|
| Polymer: Soft acrylic resin (Cryscoat P-1018GS (20% solution), product of Dai-Nippon Ink Chemical Industries Co., Ltd.) | 30 g |
| Phthalic acid ester | 3.5 g |

The above composition was placed in methyl ethyl ketone and dissolved by means of a propeller mixer to give a coating solution for subbing layer having a viscosity of 10 PS (at 20° C.). The coating solution was uniformly coated on a polyethylene terephthalate sheet (thickness: 300 μm, genuine support, placed on a glass plate) using a doctor blade. The coated layer was dried to give a subbing layer of 20 μm thick on the support. on the subbing layer of the support was placed the stimulable phosphor sheet under pressure and heating. The application of pressure and heating was carried out continuously using a calendar rolls at 500 kgw/cm$^2$, 90° C. (upper roll), 75° C. (lower roll), and a passage rate of 1.0 m/min. The phosphor sheet and the support were firmly combined after being passed through the calendar rolls to give a composite sheet having 220 μm.

[Preparation of Coated Protective Layer]

| Composition | |
|---|---|
| Fluororesin: Fluoroolefin-vinyl ether copolymer (Lumiflon LF-504X (40% solution), product of Asahi Glass Co., Ltd.) | 50 g |
| Cross-linking agent: Isocyanate (Olester NP-38-70S (70% solution), product of Mitsui-Toatsu Chemical Co., Ltd.) | 9 g |
| Lubricant: Alcohol modified-silicone (X-22-2809 (solid content: 66%), product of Shin-etsu Chemical Industries Co., Ltd.) | 0.5 g |
| Catalyst: Dibutyltin laurate (KS 1260, product of Kyodo Chemicals Co., Ltd.) | 3 mg |

The above composition was dissolved in a mixture of methyl ethyl ketone and cyclohexane (2/8, volume ratio) to give a coating solution of a viscosity in the range of 0.2 to 0.3 PS (at 25° C.). The coating solution was coated on the cushioning layer using a doctor blade. The coated layer was dried at 120° C. for 30 minutes for heat-curing to give a coated protective layer of a thickness of 3 μm.

Thus, a radiation image storage panel of the invention comprising a support, a undercoating layer, a stimulable phosphor layer, a cushioning layer, and a protective layer was prepared.

EXAMPLE 4

The procedures of Example 1 were repeated except for changing the compositions of the phosphor layer, the cushioning layer and the protective layer, to prepare a radiation image storage panel of the invention comprising a support, a undercoating layer, a stimulable phosphor layer, a cushioning layer, and a protective layer.

Composition for stimulable phosphor layer

| | |
|---|---|
| Stimulable phosphor ($BaFBr_{0.85}I_{0.15}:Eu^{2+}$) | 200 g |
| Binder: Polyurethane elastomer (Kuramylon U-8165 (solid), product of Kuraray Co., Ltd.) | 8.0 g |
| Anti-yellowing agent: Epoxy resin (Epikote 1001 (solid), product of Yuka Shell Epoxy Co., Ltd.) | 2.0 g |

The above composition was placed in tetrahydrofuran and dispersed by means of a propeller mixer to give a coating dispersion of a viscosity of 30 PS (at 25° C.) in which the ratio of binder to phosphor was 1/20.

Composition for cushioning layer

| | |
|---|---|
| Polymer: Polyurethane elastomer (Kuramylon U-8165 (solid), product of Kuraray Co., Ltd.) | 8.0 g |
| Anti-yellowing agent: Epoxy resin (Epikote 1001 (solid), product of Yuka Shell Epoxy Co., Ltd.) | 2.0 g |

The above composition was placed in tetrahydrofuran and dissolved by means of a propeller mixer to give a coating solution of a viscosity of 0.5 to 0.8 PS (at 25° C.).

Composition for coated protective layer

| | |
|---|---|
| Fluororesin: Fluoroolefin-vinyl ether copolymer (Lumiflon LF-100 (50% solution), product of Asahi Glass Co., Ltd.) | 50 g |
| Cross-linking agent: Polyisocyanate (Colonate HX, solid content: 100%) | 5 g |

-continued

| Composition for coated protective layer | |
|---|---|
| Lubricant: Alcohol modified-silicone (X-22-2809 (solid content: 66%), product of Shin-etsu Chemical Industries Co., Ltd.) | 0.5 g |

The above composition was placed in methyl ethyl ketone and dissolved to give a coating solution of a viscosity in the range of 0.1 to 0.3 PS (at 25° C.).

Comparison Example 3

The procedures of Example 3 were repeated except for employing no coating solution for the cushioning layer, to prepare a radiation image storage panel for comparison comprising a support, a undercoating layer, a stimulable phosphor layer, and a protective layer.

Comparison Example 4

The procedures of Example 4 were repeated except for employing no coating solution for the cushioning layer, to prepare a radiation image storage panel for comparison comprising a support, a undercoating layer, a stimulable phosphor layer, and a protective layer.

Comparison Example 5

The procedures of Example 3 were repeated except for placing no protective layer, to prepare a radiation image storage panel for comparison comprising a support, a undercoating layer, a stimulable phosphor layer, and a cushioning layer.

The radiation image storage panels of Examples 3 and 4 and Comparison Examples 3 to 5 were examined in their elongations at rupture and transferring durabilities in the manners as described before. The results are set forth in Table 2.

TABLE 2

| | Transferring Durability | Elongation at Rupture | |
|---|---|---|---|
| | (cracks on protective layer) | Cushioning layer | Protective layer |
| Example 3 | Not observed after 10,000 cycles | 1,038% | 40% |
| Example 4 | Not observed after 10,000 cycles | 865% | 10% |
| Com. Ex. 3 | Observed after 2,500 cycles | — | 40% |
| Com. Ex. 4 | Observed after 7,000 cycles | — | 10% |
| Com. Ex. 5 | Observed after 6,000 cycles | — | 10% |
| | | 1,038% | — |

Further, no staining was observed on the test sheets of Examples 3 and 4 and Comparison Examples 3 and 4 at the sites where the test sheets had been in contact with the transferring means after 3,000 cycles. However, some staining was observed on the test sheet of Comparison Example 5.

From the results shown in Table 2 and the above results, it has been confirmed that the radiation image storage panels of the invention are resistant to staining and have satisfactory transferring durability.

We claim:

1. A radiation image storage panel comprising a stimulable phosphor layer, a cushioning layer and a coated protective layer, wherein the cushioning layer shows an elongation at rupture more than that of the protective layer.

2. The radiation image storage panel of claim 1, wherein the protective layer is made of a fluororesin.

3. The radiation image storage panel of claim 1, wherein the elongation at rupture of the cushioning layer is not less than 100%.

4. The radiation image storage panel of claim 1, wherein the elongation at rupture of the cushioning layer is more than that of the protective layer by not less than 50%.

5. The radiation image storage panel of claim 1, wherein the cushioning layer comprises a polyurethane elastomer.

6. The radiation image storage panel of claim 1, wherein the cushioning layer and the protective layer both are independent of each other.

7. The radiation image storage panel of claim 1, wherein the cushioning layer and the protective layer are continuous to each other.

8. The radiation image storage panel of claim 1, wherein the cushioning layer has a thickness in the range of 0.1 to 50 μm.

9. The radiation image storage panel of claim 1, wherein the cushioning layer has a thickness in the range of 0.5 to 20 μm.

10. A process for preparing the radiation image storage panel of claim 1 which comprises the steps of:

coating a phosphor layer-forming coating dispersion which contains particles of stimulable phosphor and a binder polymer in a solvent and a cushioning layer-forming solution which contains in a solvent a polymer showing an elongation at rupture greater than that of the polymer of the below-mentioned protective layer simultaneously on a support to form a continuous layer comprising a stimulable phosphor layer and a cushioning layer on the support; and coating a protective layer-forming solution which contains a polymer in a solvent on the cushioning layer to form a coated protective layer.

* * * * *